US008770347B2

(12) United States Patent
Bemis

(10) Patent No.: US 8,770,347 B2
(45) Date of Patent: Jul. 8, 2014

(54) RIGGING SYSTEM SAFETY DEVICE

(75) Inventor: Christopher Joseph Bemis, Excelsior, MN (US)

(73) Assignee: Lebesgue Holdings LLC, Excelsior, MN (US)

( * ) Notice: Subject to any disclaimer, the term of this patent is extended or adjusted under 35 U.S.C. 154(b) by 222 days.

(21) Appl. No.: 13/219,015

(22) Filed: Aug. 26, 2011

(65) Prior Publication Data

US 2013/0048424 A1 Feb. 28, 2013

(51) Int. Cl.
*A62B 1/00* (2006.01)
*A62B 35/00* (2006.01)

(52) U.S. Cl.
CPC ..... *A62B 35/0068* (2013.01)
USPC ..... 182/45; 182/3; 182/129; 212/178; 212/179; 212/301

(58) Field of Classification Search
USPC ..... 182/3, 4, 36, 129, 142, 145, 45; 212/178, 179, 301
See application file for complete search history.

(56) References Cited

U.S. PATENT DOCUMENTS

| | | | | | |
|---|---|---|---|---|---|
| 494,473 | A | * | 3/1893 | Garrison | 212/294 |
| 628,592 | A | * | 7/1899 | Terry | 212/179 |
| 1,247,706 | A | * | 11/1917 | Moran | 212/179 |
| 1,252,438 | A | | 1/1918 | Hoffman | |
| 2,305,202 | A | * | 12/1942 | Smith | 212/179 |
| 2,446,093 | A | * | 7/1948 | Lambert | 248/237 |
| 2,754,087 | A | * | 7/1956 | Johnson | 173/28 |
| 3,533,487 | A | | 10/1970 | Norin | |
| 3,671,015 | A | * | 6/1972 | Sullivan | 254/332 |
| 3,854,550 | A | * | 12/1974 | Shingler | 182/36 |
| 3,978,989 | A | * | 9/1976 | Avila, Jr. | 212/176 |
| 4,004,778 | A | * | 1/1977 | Steinhagen | 212/294 |
| 4,096,922 | A | | 6/1978 | Fisher | |
| 4,190,233 | A | * | 2/1980 | Godfrey | 254/4 B |
| 4,234,055 | A | * | 11/1980 | Beeche | 182/142 |
| 4,237,999 | A | | 12/1980 | Batreau | |
| 4,406,351 | A | * | 9/1983 | Littlejohn et al. | 182/47 |
| 4,801,117 | A | * | 1/1989 | Take | 248/237 |
| 5,065,838 | A | * | 11/1991 | Finley | 182/38 |
| 5,135,078 | A | * | 8/1992 | Bell et al. | 182/142 |
| 5,341,898 | A | * | 8/1994 | Baziuk | 182/142 |
| 5,423,398 | A | * | 6/1995 | Brown | 182/142 |
| 5,498,011 | A | * | 3/1996 | Kilada et al. | 280/47.34 |
| 5,597,081 | A | * | 1/1997 | Shirley | 212/299 |
| 5,934,437 | A | * | 8/1999 | Anson et al. | 193/15 |
| 6,135,300 | A | * | 10/2000 | Fox | 212/179 |
| 6,539,676 | B2 | * | 4/2003 | Price | 52/127.2 |
| 7,044,313 | B2 | * | 5/2006 | Haliburda, III | 212/179 |
| 7,520,398 | B1 | * | 4/2009 | Ledman | 212/179 |

* cited by examiner

*Primary Examiner* — Alvin Chin Shue
*Assistant Examiner* — Colleen M Chavchavadze
(74) *Attorney, Agent, or Firm* — Pauly, DeVries Smith & Deffner, LLC

(57) ABSTRACT

Disclosed herein, amongst other things, is a system for providing added safety for workers using rigging systems. In an embodiment, the invention includes a safety device for a roof rigging system including a rigger arm having a proximal end and a distal end; an attachment member disposed on the distal end of the rigger arm, the attachment member defining an aperture, the attachment member configured to engage a rigging line with the aperture; and a blocking member disposed on the distal end of the rigger arm, the blocking member configured to interface with the attachment member to prevent engagement of the attachment member with the rigging line by occluding the aperture when a counterweight is not attached to the roof rigging system.

18 Claims, 9 Drawing Sheets

RIGGING SYSTEM SAFETY DEVICE

TECHNICAL FIELD

This disclosure relates generally to rigging systems and, more particularly, to safety systems for rigging systems such as roof rigging systems and related methods.

BACKGROUND OF THE INVENTION

The maintenance of high-rise buildings skyscrapers requires regular cleaning of windows, as well as other cleaning, painting, inspection, and repairs of the exterior of the building. Such maintenance requires specialized devices for supporting workers and/or devices for performing the cleaning or repairing tasks.

Some buildings have equipment that is specially designed for the particular buildings to assist in these tasks. Other buildings use portable roof riggers that may be moved from building to building. Roof rigging systems (or roof riggers) are used for anchoring a line from the top of a building.

Regardless of the specific roof rigger apparatus used, all or most roof riggers use a rigger arm that supports an individual suspended on the outside of a building. The rigger arm starts from the roof of the building and extends out over the side of the building with a mechanism, such as an eyelet, from which a worker (and/or an associated equipment or devices) can attach or clip in with a rope before he or she ascends or descends along the outside of the building.

SUMMARY OF THE INVENTION

Disclosed herein, amongst other things, is a system for providing added safety for workers using rigging systems in the course of tasks such as window cleaning or other tasks performed on the exterior of high-rise buildings or other tall structures.

In an embodiment, the invention includes a safety device for a roof rigging system including a rigger arm having a proximal end and a distal end; an attachment member disposed on the distal end of the rigger arm, the attachment member defining an aperture, the attachment member configured to engage a rigging line with the aperture; and a blocking member disposed on the distal end of the rigger arm, the blocking member configured to interface with the attachment member to prevent engagement of the attachment member with the rigging line by occluding the aperture when a counterweight is not attached to the roof rigging system.

In an embodiment, the invention includes a method for increasing the safety of using a roof rigging system. The method can include providing a rigger arm having a proximal end and a distal end. The method can also include providing an attachment member disposed on the distal end of the rigger arm, the attachment member defining an aperture, the attachment member configured to engage a rigging line with the aperture. The method can also include preventing engagement of the attachment member if a counterweight is not attached to the roof rigging system.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present invention is defined by the appended claims and their legal equivalents.

BRIEF DESCRIPTION OF THE DRAWINGS

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

Workers who perform tasks on the exterior of high-rise buildings or other tall structures frequently need to suspend themselves over the sides of the buildings or structures. Worker safety is a substantial concern because of the risks inherent in performing such tasks.

As an example of such a task, many methods of window washing involve suspending a worker from a solid base on the roof of a building. A worker can tie off from a fixed point and rappel down the side of the building while washing windows. This, however, allows for very little horizontal movement by the worker.

Instead, most window washers use rigger systems that allow the worker to move both vertically and horizontally along the sides of high-rise buildings or other tall structures. Such systems can use a pulley system and a counterweight to balance the weight of the worker being suspended from the building. In general, after a counterweight is attached to the roof rigger, a worker attaches himself to the roof rigger, often with a carabiner or other clip, and can descend the side of the building.

However, circumstances can arise wherein the worker does not use the equipment properly. For example, a worker may forget to attach the counterweight to the roof rigger. In the event that the counterweight is not properly attached to the roof rigger system, there is insufficient weight on the roof rigger to counterbalance the worker's weight and the worker could fall from the building.

Embodiments herein include systems, devices and methods that can prevent or substantially diminish the chances of accidents from occurring in the context of roof rigger use. In various embodiments, a safety system is included that physically prevents the worker from attaching rigging lines to a roof rigging system unless a counterweight is already attached.

Figure 1:
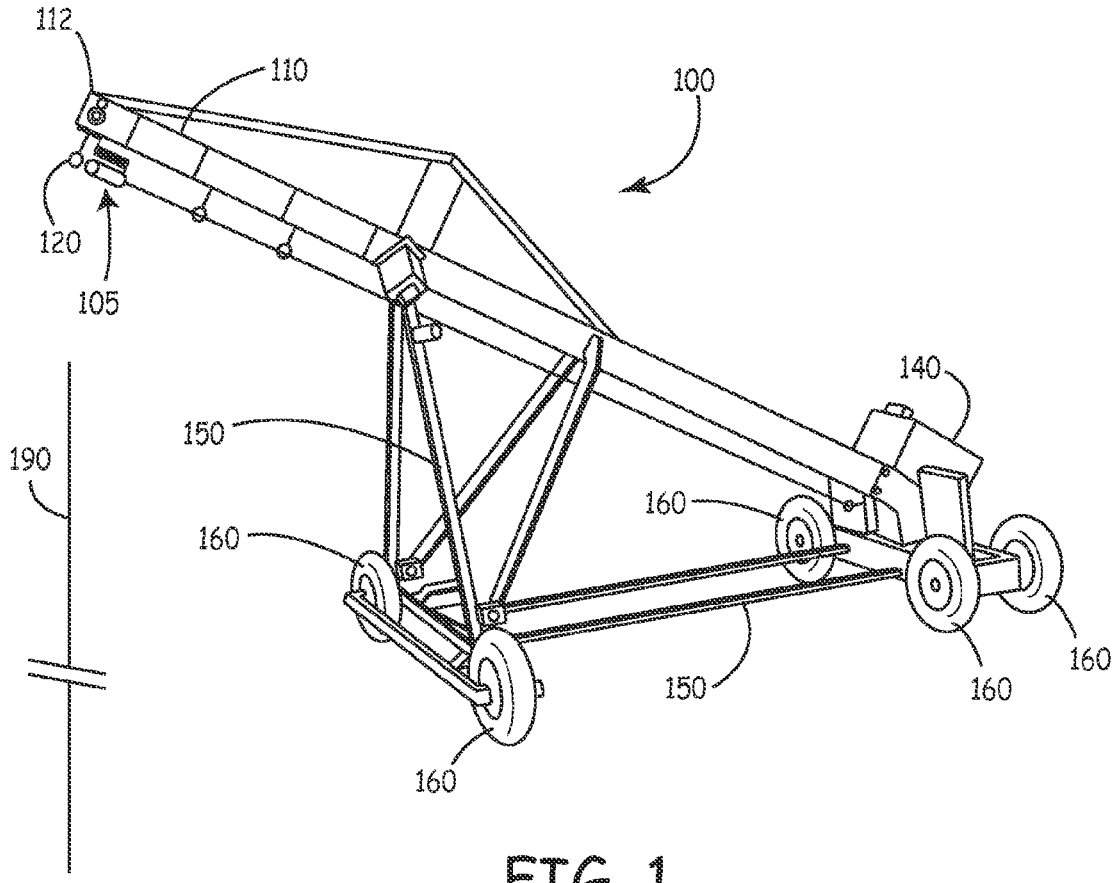
FIG. 1 is a schematic view of a roof rigger system with a safety device system in accordance with at least one embodiment.

FIG. 1 shows a schematic view of a roof rigger system 100 with a safety system in accordance with at least one embodiment. It will be appreciated that this illustration is provided only by way of example and that embodiments included within the scope herein can vary substantially from this specific example. The roof rigger system 100 can include a frame 150. The frame can be made of various materials including metals, polymers, composites, and the like. In some embodiments, the frame can be made of a metal, such as aluminum. The roof rigger system can optionally include wheels 160 to allow for movement of the roof rigger system 100. The roof rigger system 100 can further include a rigger arm 110 (fulcrum arm or rigger boom) and an attachment member 120. The rigger arm 110 can be sized and configured appropriately to support various working loads. In some embodiments, the rigger arm 110 can support at least about 1000 pounds or more. In some embodiments, the rigger arm 110 can support at least about 2000 pounds or more. The rigger arm 110 can be solid or hollow. The rigger arm 110 can be made of various materials including metals, polymers, composites, and the like. The attachment member 120 can be located adjacent to the distal end 112 of the rigger arm 110. In use, a worker can fasten a rigging line 190 to the attachment member 120 before descending the side of a tall structure. The rigging line can be attached to the attachment member 120 using various means such as clips, carabiners, hooks, eyelets, fasteners, knots, or the like.

The roof rigger system 100 can further include a counterweight 140, such as a detachable counterweight. The counterweight 140 can be attached to the roof rigger system 100 and can also be detached to facilitate moving the roof rigger system 100. In some embodiments the counterweight 140 is a single unitary structure. In other embodiments, the counterweight 140 can include multiple separable pieces, such as multiple plates. The counterweight 140 can be made of various materials including metals, cementitious materials, stone, and the like. In some embodiments, the counterweight can be a fluid containing structures such as a plastic or metal container filled with a liquid such as water. In some embodiments, the counterweight 140 comprises a counterweight encasement or holder that can hold or otherwise be attached to various weights.

The roof rigger system 100 can include a roof rigger safety system 105. The roof rigger safety system 105 functions to prevent or substantially diminish the chances of certain types of accidents from occurring in the context of roof rigger use, such as those accidents stemming from a failure to properly attach a counterweight to the roof rigger system 100. The roof rigger safety system 105 can physically prevent a worker from attaching rigging lines to a roof rigging system unless a counterweight is already attached. Aspects of the roof rigger safety system 105 are described in greater detail below.

In some embodiments, the roof rigger system 100 is secured to a heavy roof support member (not shown) as a back-up to prevent the roof rigger system 100 from falling off the structure. In some embodiments such a roof support member can secure up to 6,000 pounds.

Figure 2:
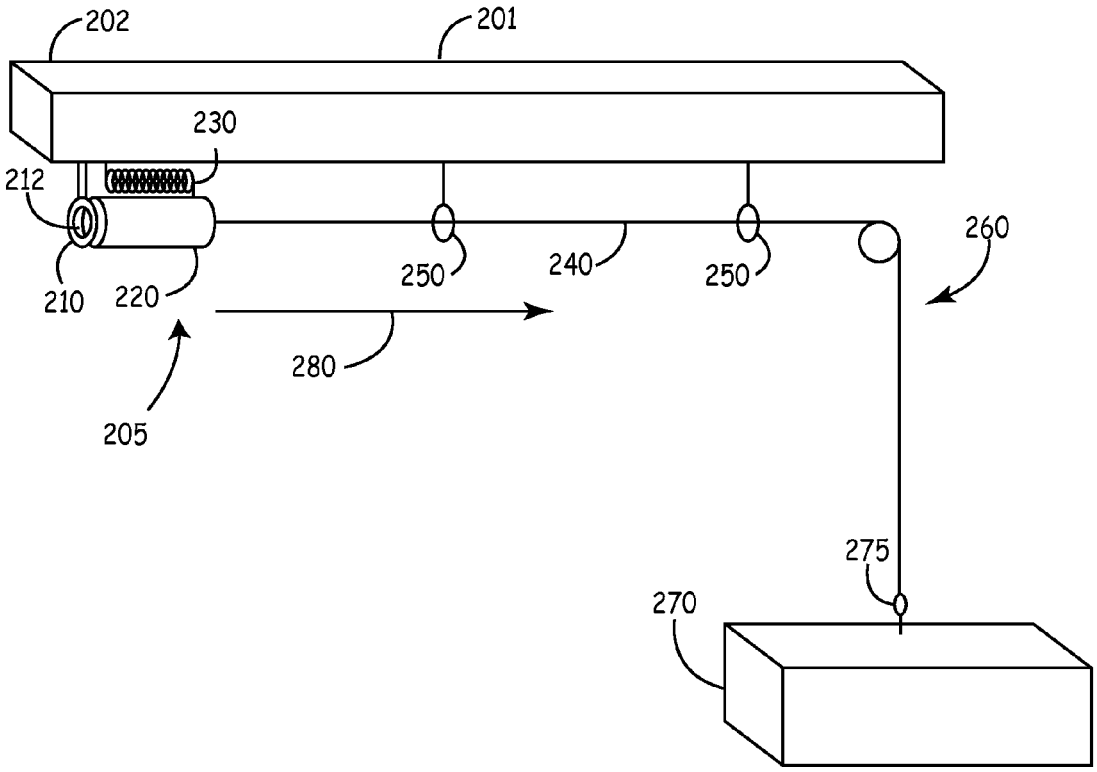
FIG. 2 is a schematic view of a safety device system according to one embodiment.

FIG. 2 is a schematic view of a safety device system 205 in conjunction with other elements of a roof rigger system according to some embodiments. In this simplified schematic view, a rigger arm 201 comprises an attachment member 210 located on the distal end 202 of the rigger arm 201. In some embodiments, the attachment member 210 defines an aperture 212, fully or at least partially, and is configured to engage a rigging line with the aperture 212. The attachment member 210 can be a full loop of a material, a partial loop of a material, a hook, an eyelet, or other similar mechanism allowing a worker to fasten a rigging line onto the rigger arm 201.

The rigger arm 201 can be operably connected to a blocking member 220. The blocking member 220 can be configured to be biased to a position (such as a closed position) where it blocks use of the attachment member 210 if a counterweight 270 is not attached to the roof rigging system. It will be appreciated that this can be accomplished in various ways. In some embodiments the blocking member 220 can block use of the attachment member 210 by physically occluding or blocking the aperture 212. In some embodiments the blocking member 220 can physically cover the aperture 212 or at least partially fit within the aperture 212. The blocking member 220 can be movable between a closed position where the blocking member 220 blocks use of the attachment member 210 and an open position where the blocking member 220 does not block use of the attachment member 210.

In some embodiments, a spring can be used in order to bias the blocking member to a closed position. In FIG. 2, the blocking member 220 is attached to a spring member 230 and a counterweight cable 240. In some embodiments, the blocking member 220 is configured to move relative to the attachment member 210. In some embodiments, the spring member 230 is attached to the rigger arm 201. The spring member 230 is also attached to the blocking member 220 so that movement by the blocking member 220 relative to the rigger arm 201 causes the spring member 230 to stretch or compress.

A counterweight 270 can be attached to the counterweight cable 240 via an attachment point 275. Attachment point 275 can include various means such as clips, carabiners, hooks, eyelets, fasteners, knots, and the like. A pulley system 260 comprises the counterweight cable 240 and counterweight 270. One or more eyelets 250 can be used to guide the counterweight cable 240 along the length of the rigger arm 201. In some embodiments, the attachment cable can be disposed within a channel inside of the rigger arm 201. Various configurations of counterweights may be used, as explained below.

At rest, when no counterweight 270 is attached to the attachment cable, the spring member 230 keeps the blocking member 220 is in a first position, abutting the attachment member 210 and preventing use of the attachment member 210. The position of the blocking member 220 abutting the attachment member 210 effectively prevents a user from tying in, clipping in, or otherwise using the attachment member and thus informs the user that no counterweight 270 is attached to the counterweight cable 240 so the system is not secured for safety. This first position can be considered to be closed as the attachment member is closed off to attachment by the user. As such, the spring member 230 is configured to bias the blocking member 220 to the closed position in various embodiments.

Figure 3:
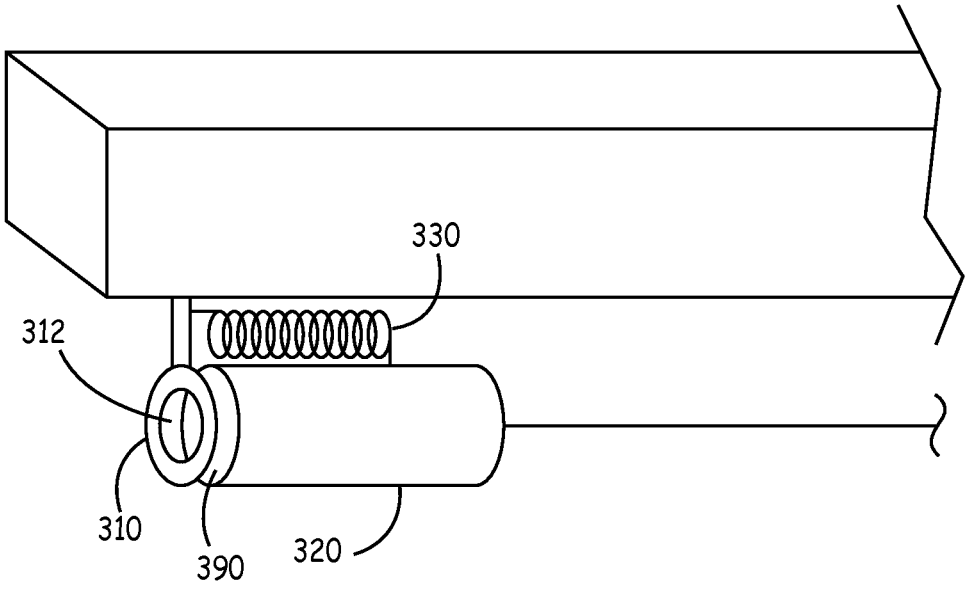
FIG. 3 is a schematic illustration of a first position of the blocking member in a safety device system where the attachment member is occluded by the blocking member.

FIG. 3 is a schematic illustration of a blocking member 320 in a first position (or closed position) in a safety device system wherein the attachment member 310 is occluded by the blocking member 320. When the blocking member 320 is in the closed position as shown, for example, in FIG. 3, occlusion of the aperture 312 prevents a user from engaging the attachment member 310 with a rigging line. The blocking member 320 can be biased to the closed position based on force provided by a spring member 330.

Figure 4:
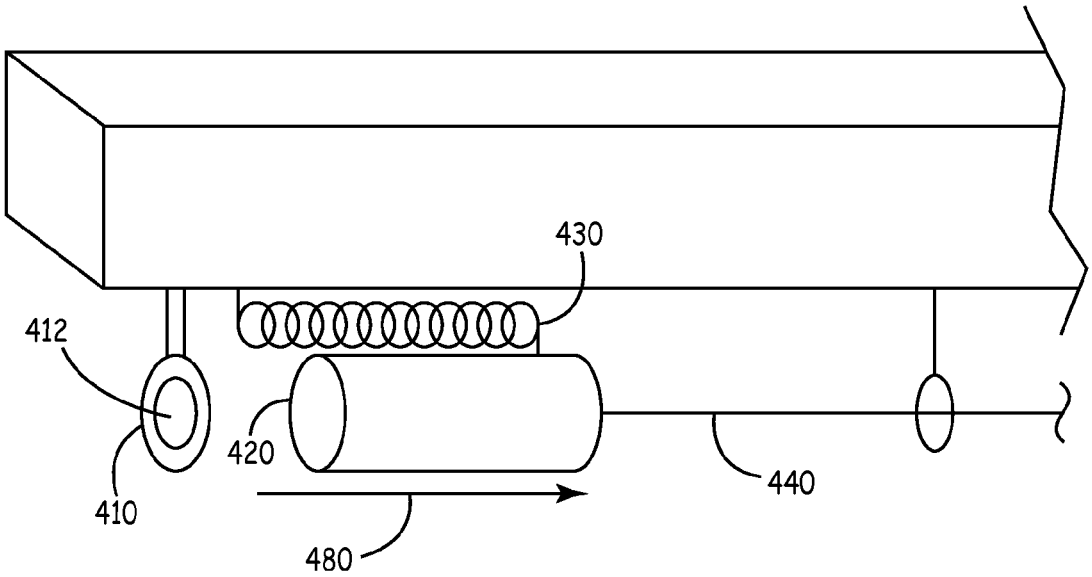
FIG. 4 is a schematic illustration of a second position of the blocking member in a safety device system where the attachment member is not occluded by the blocking member.

FIG. 4 is a schematic illustration of a blocking member 420 in a second position (or open position) in a safety system wherein the attachment member 410 is not occluded by the blocking member 420. When the blocking member 420 is in the open position as shown a user may engage the non-occluded aperture 412 with a rigging line or the like. When an adequate counterweight (not shown) is attached to the end of the counterweight cable 440 the force of the counterweight causes the counterweight cable 440 to be pulled in the direction indicated by 480. This can cause the blocking member 420 to be pulled away from the attachment member 410 in the direction of arrow 480. For example, the force of the counterweight can cause the spring member 430 to stretch, as shown in FIG. 4. In the second position, the blocking member 420 no longer abuts or occludes the attachment member 410 and allows for the use of the attachment member 410. As the blocking member 420 is no longer blocking the attachment member 410, the user then knows that adequate counterweight is attached to the end of the counterweight cable 440 for safety and can then tie in or clip in at the attachment member 410 and descend down the side of the building. This second position is considered to be open as the aperture of the attachment member 410 is open and a user may attach a rigging line to the attachment member 410.

Figure 5:
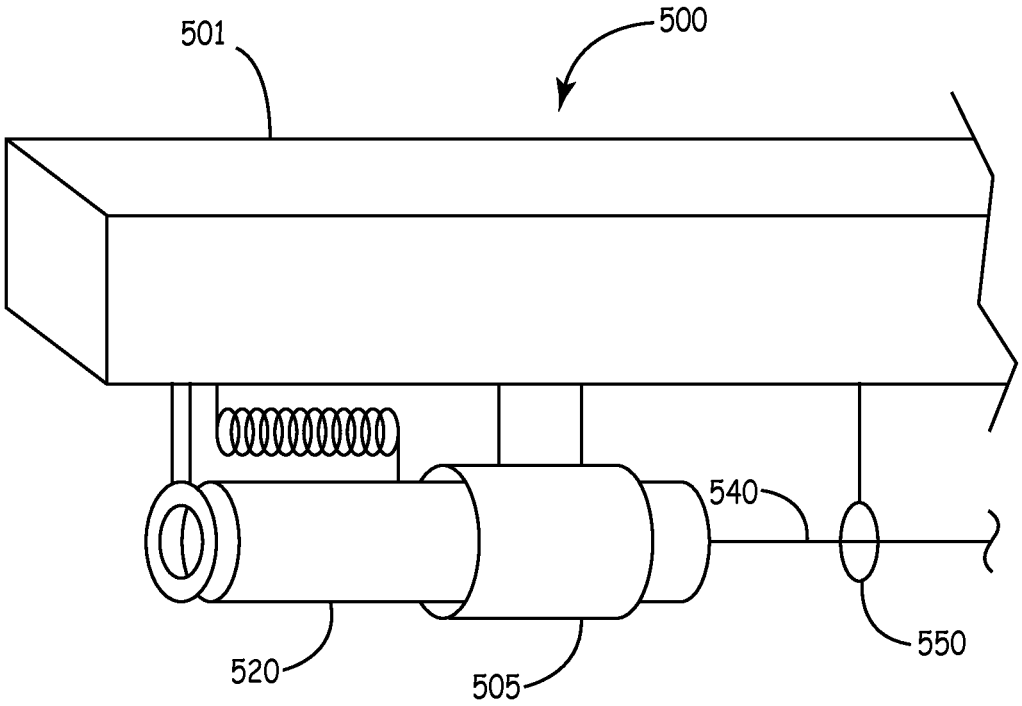
FIG. 5 is schematic view of another embodiment of a safety device system that includes a guiding tube to facilitate a path for the blocking member.

In some embodiments, the system can include a guiding structure in order to control the path of movement of the blocking member and/or support the blocking member. For example, in some embodiments of the rigging system 500, a guiding structure 505, such as a guide tube, is used to facilitate a path of movement for the blocking member 520 along the rigger arm 501, as shown in FIG. 5. While a tube is depicted in FIG. 5, it will be appreciated that a guiding structure 505 can take on many different forms. Various structures can be used as a guide for the counterweight cable 540. In some embodiments, one or more eyelets 550 can be used to guide the counterweight cable 540 along the length of the rigger arm 501.

Figure 6:
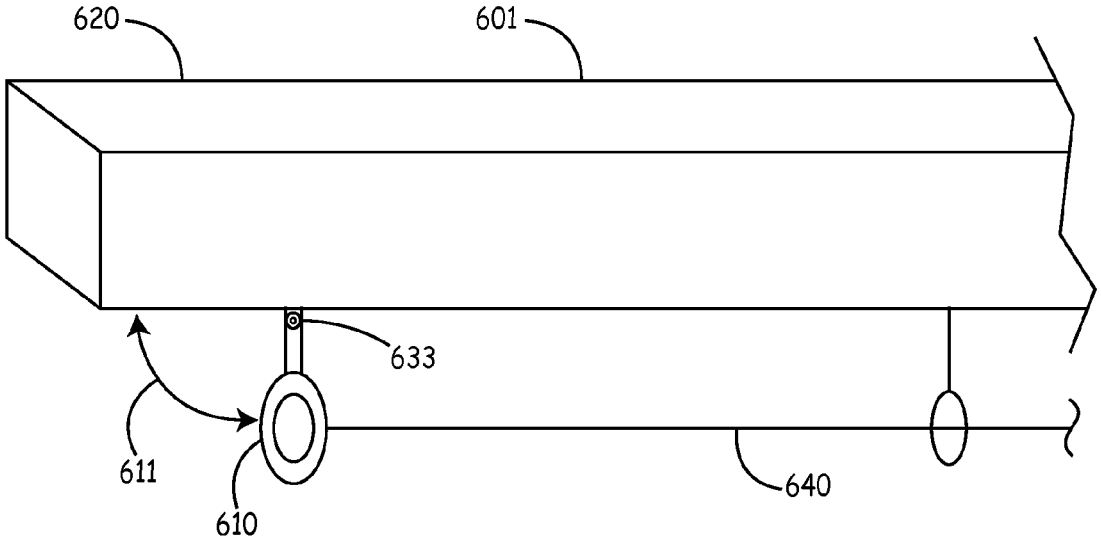
FIG. 6 is a schematic view of another embodiment of the blocking member and attachment member of the safety device system.

While in many embodiments the blocking member is movable, in some embodiments the attachment member itself is movable. For example, FIG. 6 shows an embodiment wherein the attachment member 610 is configured to move relative to the blocking member 620. In the example embodiment shown in FIG. 6, the rigger arm 601, or a structure attached thereto, acts as the blocking member 620. The attachment member 610 can be configured to pivot in the direction shown by arrow 611. The attachment member 610 can be mounted with a hinge joint 633 to facilitate its movement. When adequate counterweight is attached to the counterweight cable 640, the attachment member 610 moves to the open position shown in FIG. 6 and permits a user to engage the attachment member 610 with a rigging line. However, when adequate weight has not been attached to the counterweight cable 640, the attachment member 610 in a closed position where a user cannot engage the attachment member 610 or where engagement of the attachment member 610 is made more difficult. In the embodiment shown in FIG. 6, for example, the attachment member 610 may pivot up as shown by arrow 611 to lay against the rigger arm 601, making attachment of a rigging line to the attachment member 610 more difficult or impossible. This arrangement of the attachment member 610 informs the user that it is not safe to engage the attachment member 610 with a rigging line as adequate counterweight has not yet been added. In some embodiments, the attachment member 610 is configured to bias to the closed position where engagement of the attachment member 610 is difficult.

Figure 7:
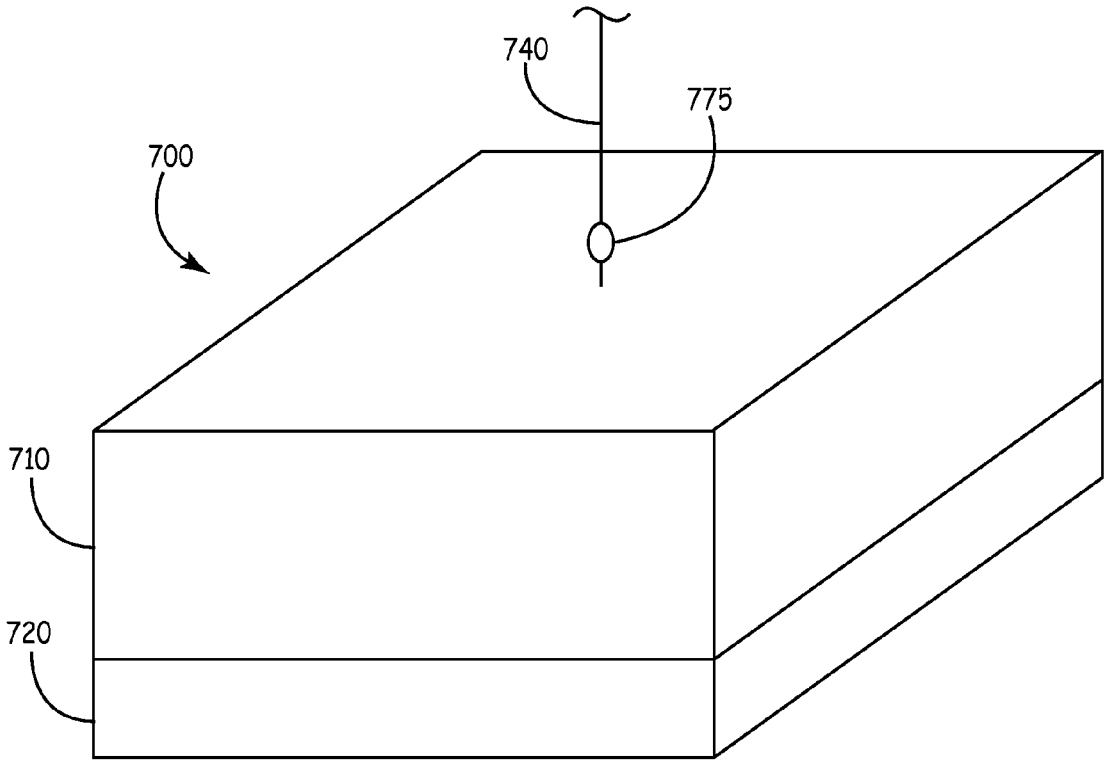
FIG. 7 is a schematic view of a counterweight encasement with a weight encasement and a spring encasement for use with the safety device.

In some embodiments, the counterweight comprises a counterweight holder 700, as shown in FIG. 7. Such a counterweight holder 700 is operably connected to the blocking member of the rigger arm. In some embodiments, the counterweight holder 700 is operably connected to the blocking member by means of a cable. The counterweight holder 700 comprises a weight encasement 710 and a spring encasement 720 and is attached to the attachment cable 740 using an attachment point 775. In some embodiments, the weight encasement 710 and the spring encasement 720 are integral with one another. The attachment point 775 may comprise any combination of one or more clips, carabiners, maillons or quick links, hooks, eyelets, fasteners, or knots. In some embodiments, the counterweight holder 700 is configured to compress when an adequate counterweight is attached to the roof rigging system. In some embodiments, an adequate counterweight is at least about 200 pounds. In one embodiment, an adequate counterweight is at least about 250 pounds. In another embodiment, an adequate counterweight is between 250 and 300 pounds. In yet another embodiment, an adequate counterweight is about 300 pounds. In some embodiments, an adequate counterweight exceeds 300 pounds.

Figure 8:
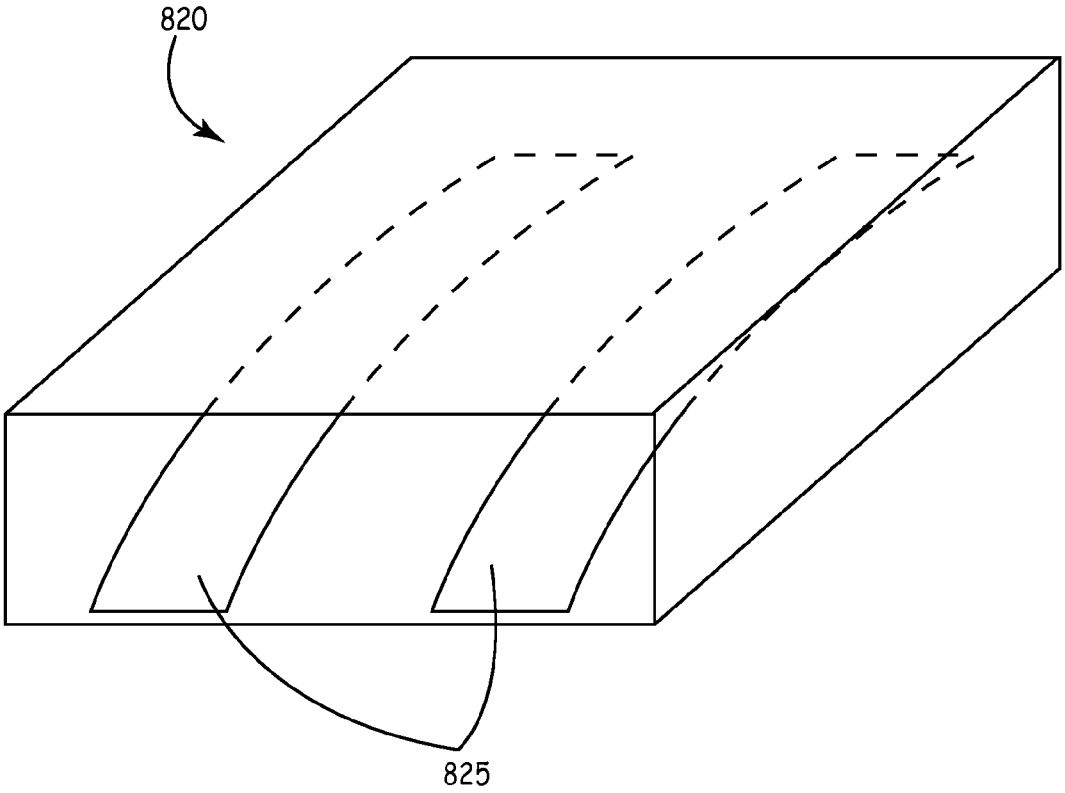
FIG. 8 is a schematic view of a spring encasement according to one embodiment of the counterweight encasement where leaf springs are provided.

In one embodiment of the counterweight holder 700, the weight encasement 710 is positioned on the spring encasement 720, such that when adequate weight is added to the weight encasement 710, the springs are caused to be depressed, thereby applying adequate tension to the connected attachment cable 740, causing the blocking member to move to an open position and unblock the aperture of the attachment member. Various types of springs may be used in the spring encasement 720. In some embodiments, the counterweight holder 700 is anchored to a fixed object. In a specific embodiment, leaf springs 825 are used in the spring encasement 820, as shown in FIG. 8, which are calibrated to the required rigger weighting.

Referring back to FIG. 3, it will be appreciated that the blocking member 320 can take on various specific physical configurations. For example, in some embodiments, the portion 390 of the blocking member 320 that serves to occlude or otherwise interfaces with the attachment member 310 can have a substantially flat surface. In other embodiments, portion 390 can have a conically shaped surface or a frustoconically (frustrum of a cone) shaped surface. In other embodiments, portion 390 can have a convex shaped surface. In some embodiments, the portion 390 can have a central projection that interfaces with the aperture 312. In some embodiments, the portion 390 of the blocking member 320 that serves to occlude or otherwise interfaces with the attachment member 310 can be the distal most portion of the blocking member.

Figure 9:
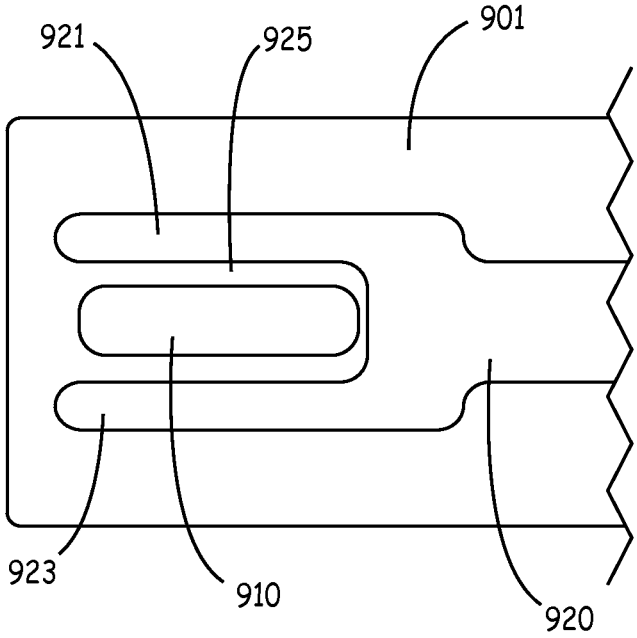
FIG. 9 is a schematic bottom view of a blocking member in accordance with various embodiments.

In some embodiments, the blocking member can define a central channel into which the attachment member fits. Referring now to FIG. 9, a schematic bottom view is shown of a portion of a blocking member 920 interfacing with an attachment member 910. The attachment member 910 is disposed on the rigger arm 901. The attachment member 910 defines an aperture (not shown in this view) that is occluded or blocked by the blocking member 920. The blocking member 920 includes a first arm 921 and a second arm 923. The blocking member 920 defines a channel 925 into which the attachment member 910, or a portion thereof, fits.

While in many embodiments a mechanical linkage (such as a cable) can be used in order to transmit the force of the counterweight to cause the attachment member to be either blocked from use or ready for use, it will be appreciated that other methods can also be employed. For example, in one embodiment, rather than utilizing a mechanical pulley system, a hydraulic system can be utilized to move the blocking member or to occlude/open the aperture of an attachment member. For example, the force of the counterweight can be used to compress a hydraulic cylinder that is in fluid communication with an actuator connected to the blocking member such that connecting the counterweight to the rigging system results in the blocking member moving to a position wherein a rigging line can be attached to the attachment member.

In another embodiment, an electronic means can be used to inform a user whether adequate counterweight has been attached to the roof rigger so that it is safe to attach a rigging line to the attachment member. When adequate weight has been added as a counterweight, a weight sensor acknowledges that adequate weight has been added and sends an electronic signal to a display located near the attachment member. In some embodiment, the display may comprise one or more lights. When adequate weight has not been added to the roof rigger, a "warning" light of one color (e.g. red or yellow) is on, informing the user not to engage the attachment member with a rigging line. When adequate weight is added as a counterweight, the "warning" light turns off and a "safe" light of another color (e.g. green) turns on, informing the user that it is safe to engage the attachment member. In another embodiment, a LCD or other display screen can be used to provide a written or other visual message to the user as to whether adequate counterweight has been attached to the roof rigger. In some embodiments, the display may provide additional information, such as the weight of the counterweight, if attached.

In yet another embodiment, the linkage between the attachment member or the blocking member and the counterweight is, at least in part, conducted through electronic or optical means. In such an embodiment, the aperture of the attachment member can be occluded when there is inadequate counterweight. However, when adequate counterweight is added, an electronic or optical signal is sent to the attachment member or the blocking member effectively opening the aperture of the attachment member, which then allows the user to engage the attachment member with a rigging line. The electronic or optical signal may cause the attachment member to move, the blocking member to move, or both.

It will be appreciated that various methods are also included within the scope herein. For example, in some embodiments a method for increasing the safety of using a roof rigging system is included. The method can include providing a rigger arm having a proximal end and a distal end, providing an attachment member disposed on the distal end of the rigger arm, the attachment member defining an aperture, the attachment member configured to engage a rigging line with the aperture, and preventing engagement of the attachment member if a counterweight is not attached to the roof rigging system.

In some embodiments, preventing engagement of the attachment member comprises providing a blocking member disposed on the distal end of the rigger arm, the blocking member configured to prevent engagement of the attachment member with the rigging line by occluding the aperture when a counterweight is not attached to the roof rigging system. In some embodiments, the blocking member is movable between a closed position wherein the blocking member occludes the aperture and an open position wherein the blocking member does not occlude the aperture. In some embodiments, the method can include providing a spring configured to bias the blocking member to the closed position. In some embodiments, the blocking member is movable between a closed position wherein the blocking member occludes the aperture and an open position wherein the blocking member does not occlude the aperture. In some embodiments, the method can further include providing a counterweight configured to move the blocking member to an open position wherein the blocking member does not occlude the aperture. In some embodiments, the method can further include providing a spring member configured to cause movement of the blocking member to the open position when a counterweight is attached to the roof rigging system.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as "arranged", "arranged and configured", "constructed and arranged", "constructed", "manufactured and arranged", and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A safety device for a roof rigging system comprising:

a rigger arm having a proximal end and a distal end;

an attachment member disposed on the distal end of the rigger arm, the attachment member defining an aperture, the attachment member configured to engage a rigging line with the aperture; and a blocking member disposed on the distal end of the rigger arm, the blocking member configured to interface with the attachment member to prevent engagement of the attachment member with the rigging line by occluding the aperture when a counterweight is not attached to the roof rigging system.

2. The safety device of claim 1, wherein the blocking member is movable between a closed position wherein the blocking member occludes the aperture and an open position wherein the blocking member does not occlude the aperture.

3. The safety device of claim 2, further comprising a spring configured to bias the blocking member to the closed position.

4. The safety device of claim 1, further comprising a counterweight holder, wherein the counterweight holder is operably connected to the blocking member.

5. The safety device of claim 4, wherein the counterweight holder is operably connected to the blocking member with a cable.

6. The safety device of claim 5, wherein the blocking member is movable between a closed position wherein the blocking member occludes the aperture and an open position wherein the blocking member does not occlude the aperture.

7. The safety device of claim 6, the counterweight holder configured to compress when a counterweight is attached to the roof rigging system.

8. The safety device of claim 6, the counterweight holder further comprising a spring member configured to cause movement of the blocking member to the open position when a counterweight is attached to the roof rigging system.

9. The safety device of claim 1, wherein the blocking member is configured to move relative to the attachment member.

10. The safety device of claim 1, the counterweight having a weight of greater than 200 pounds.

11. The safety device of claim 1, the attachment member comprising a structure selected from the group consisting of a loop, a hook, and an eyelet.

12. A method for increasing the safety of using a roof rigging system comprising:

providing a rigger arm having a proximal end and a distal end;

providing an attachment member disposed on the distal end of the rigger arm, the attachment member defining an aperture, the attachment member configured to engage a rigging line with the aperture; and preventing engagement of the attachment member with the rigging line if a counterweight is not attached to the roof rigging system.

13. The method of claim 12, wherein preventing engagement of the attachment member comprises providing a blocking member disposed on the distal end of the rigger arm, the blocking member configured to prevent engagement of the attachment member with the rigging line by occluding the aperture when a counterweight is not attached to the roof rigging system.

14. The method of claim 13, wherein the blocking member is movable between a closed position wherein the blocking member occludes the aperture and an open position wherein the blocking member does not occlude the aperture.

15. The method of claim 14, further comprising providing a spring configured to bias the blocking member to the closed position.

16. The method of claim 13, further comprising a counterweight, wherein the counterweight is operably connected to the blocking member.

17. The method of claim 16, wherein the blocking member is movable between a closed position wherein the blocking member occludes the aperture and an open position wherein the blocking member does not occlude the aperture.

18. The method of claim 13, further comprising providing a counterweight configured to move the blocking member to an open position wherein the blocking member does not occlude the aperture.

* * * * *